United States Patent [19]

Mumford

[11] 4,093,103

[45] June 6, 1978

[54] TABLET CONTAINER

[75] Inventor: George V. Mumford, Toledo, Ohio

[73] Assignee: Owens-Illinois, Inc., Toledo, Ohio

[21] Appl. No.: 770,555

[22] Filed: Feb. 22, 1977

[51] Int. Cl.[2] ..... B65D 43/16

[52] U.S. Cl. ..... 220/283; 206/530; 206/539; 220/23; 206/1.5

[58] Field of Search ..... 206/530, 538, 539, 533, 206/540, 1.5; 220/281, 282, 283, 23

[56] References Cited

U.S. PATENT DOCUMENTS

| | | | |
|---|---|---|---|
| 2,033,760 | 3/1936 | Driess | 220/283 |
| 2,257,682 | 9/1941 | Hermani | 220/283 |
| 3,415,361 | 12/1968 | Adams, Jr. et al. | 220/23 |
| 3,749,230 | 7/1973 | Foster | 220/283 |
| 3,894,655 | 7/1975 | Mattheis et al. | 220/283 |
| 3,968,880 | 7/1976 | Ostrowsky | 220/281 |

*Primary Examiner*—William Price
*Assistant Examiner*—Joseph Man-Fu Moy
*Attorney, Agent, or Firm*—Richard D. Heberling; Myron E. Click; David H. Wilson

[57] ABSTRACT

Containers for storing various pills are provided which have excellent water vapor permeation resistance and which includes child-resistant opening features. The container includes a top and a bottom which are adapted for telescopic positioning with respect to each other in a generally flush-like manner so that edge exposures are kept to a minimum and the top and bottom each include means which are brought into interengagement to define a sealed internal chamber for storing tablets, such as aspirin. Wall portions of the top and bottom are configured to preclude opening of the container except by exertion of a compressive force at selective locations. Such selective application of compressive force between the top and the bottom allows the top to be removed from the bottom in a generally pivotal lever-like manner about a hinge connection by the engagement of a fulcrum surface on the bottom with the internal surface of a portion of the top.

9 Claims, 7 Drawing Figures

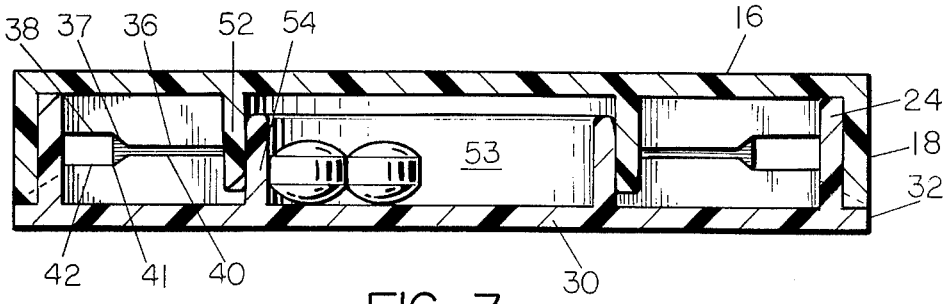
FIG. 3
FIG. 5
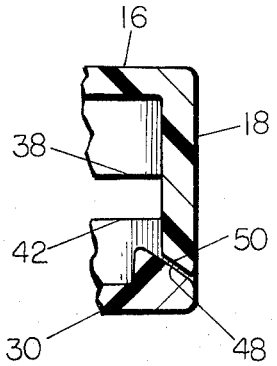
FIG. 7
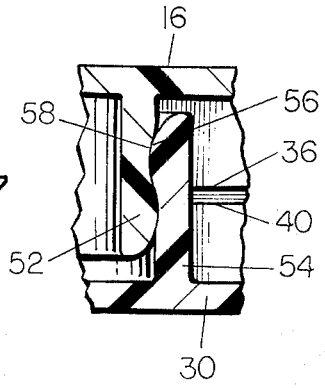
FIG. 4
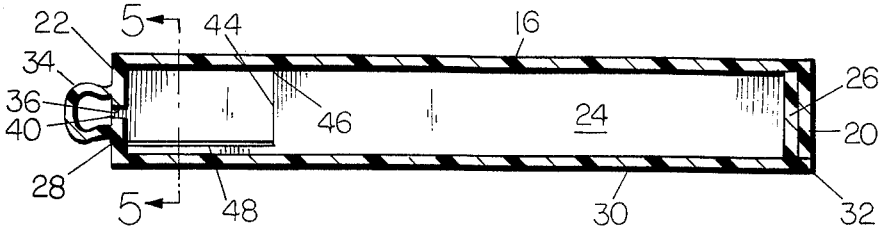
FIG. 6
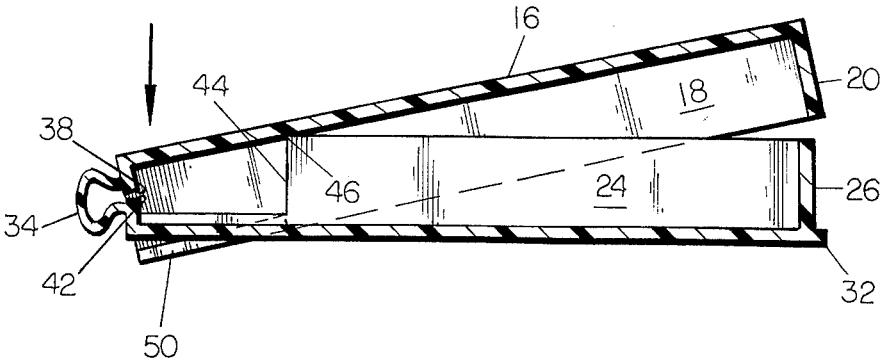

TABLET CONTAINER

THE INVENTION

The present invention relates to plastic tablet boxes and more particularly to plastic tablet boxes which are integrally formed as a single piece container.

The container art is replete with diverse types of containers, or receptacles, for tablets such as, for example, pills, capsules, and other like medicinal tablets. Exemplary of such patents are U.S. Pat. Nos. 1,369,819, 2,257,682, 2,271,630, 3,294,222, 3,894,655, 3,954,179, and 3,968,880. Notwithstanding the existence of numerous types of tablet containers there is still a need in the art for providing a tablet container which can be expediently and cheaply manufactured and which tablet container has child resistant opening features and which container provides for a seal between the tablets and the environment which will preclude any deterioration in the quality of the tablet. There is especially a need in the art, in view of recent regulations, to provide a container for tablets which will satisfy requirements for a minimum amount of water vapor permeation into the tablets so as to preclude undesirable hydrolysis, hydration, and the like.

In accordance with the present invention applicant has satisfied this need in the art by providing for a tablet container which has superior sealing characteristics and which has features which allow adults to easily open the container but which features are sufficiently difficult to activate that young children encounter difficulty in opening such containers. The containers can be expediently and economically manufactured from suitable plastics such as, for example, polyolefins, like polyethylene and, preferably, polypropylene as a single-piece article. The container comprises: a lid with a top panel having a peripheral skirt depending downwardly from said top panel; a base having a bottom panel and a skirt extending upwardly from said bottom panel, said base skirt having at least one downwardly extending surface which merges with an upper surface thereof to define a fulcrum surface; hinge means joining said lid and base and allowing for said lid and base to be brought into telescopic relation; motion limiting means for limiting, when said lid and base are in close telescopic relation, relative closer approaching movement of said top panel and said bottom panel to a non-opening position; first wall means integral with top panel and second wall means integral with said bottom panel, said first and second wall means being inter-engageable to define a sealed, internally disposed tablet chamber upon relative telescopic positioning of said lid and base; displaced surface means generally disposed along the periphery of said container, at a location intermediate said motion limiting means and said fulcrum, so arranged and constructed that upon compression of adjacent portions of said top panel and bottom panel said surface means are brought into closer proximity to each other so as to produce, along with contact of an internal surface portion of said top panel with said fulcrum, a lever-like action which disengages said first and second wall means to pivotally open said container and tablet chamber; and cam means, generally disposed along the periphery of said container intermediate said fulcrum and said displaced surface means, so arranged and constructed that upon compression of said top and bottom panels a portion of said peripheral skirt of said lid is forced outwardly.

The foregoing and other advantageous features of the present invention will be more apparent by reference to the drawings wherein:

FIG. 3 is a fragmentary sectional view generally taken along line 3—3 of FIG. 2;

FIG. 4 is a fragmentary sectional view generally taken along line 4—4 of FIG. 2;

FIG. 5 is generally taken along the line 5—5 of FIG. 4 and is a partial fragmentary view more clearly showing the cam features of the container;

FIG. 6 is a fragmentary view generally illustrating the lever-like opening of the container.

FIG. 7 represents an alternate embodiment for providing a sealed internal chamber.

Figure 1:
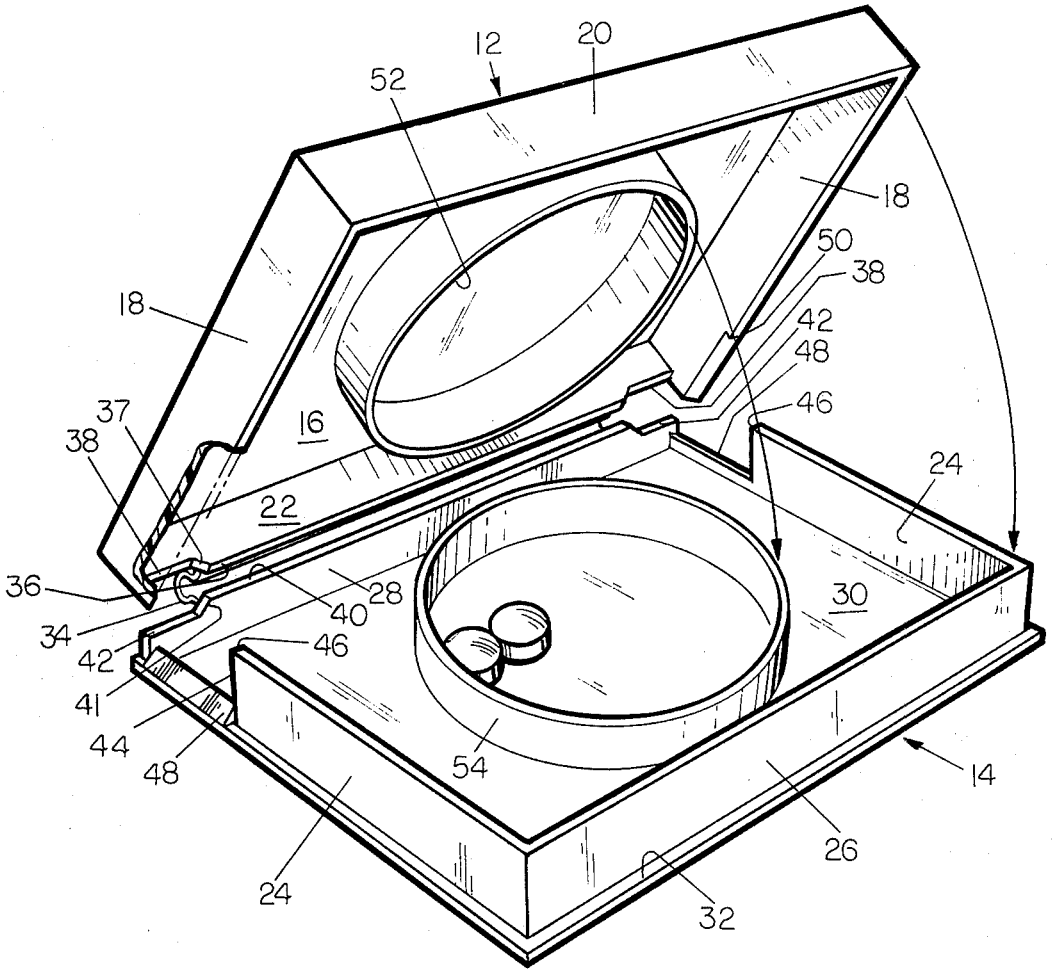
FIG. 1 is a perspective view, with a portion cut away, showing the lid in an open position relative to the base portion of the container and exemplifies various features of the container.
Figure 2:
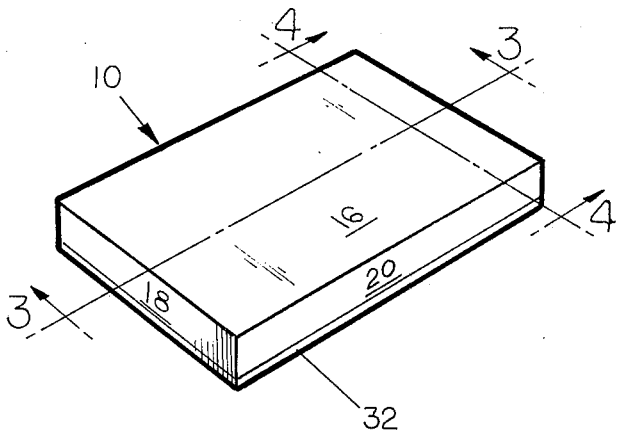
FIG. 2 is a perspective view showing the container in a closed position.

In the drawings there is exemplified a selectively openable, telescopically closeable tablet container 10 generally in the form of a quadrilateral which container includes a top, or lid 12, and a bottom, or base, 14. As will be apparent the lid and base are adapted to be brought into telescopic closed relationship. Lid 12 includes a panel 16 and, generally proceeding downwardly therefrom, a peripheral skirt which as illustrated includes opposed sidewalls 18, front wall 20, and a rear wall 22. Depending downwardly from the internal surface of panel 16 is an annular wall 52. Bottom, or base, 14 includes a panel 30, opposed sidewalls 24 a front wall 26 and a rear wall 28 which walls proceed upwardly from panel 30. Front wall 26 is joined with opposed sidewalls 24 but in the outward, or rearward, direction of container 10, each sidewall 24 is interrupted and includes generally vertically disposed wall-edges 44 which edges, along with the upper surface margin of sidewalls 24, define opposed fulcrum surfaces 46. Also proceeding upwardly, and disposed internally of the quadrilateral container 10, is an annular wall 54 integrally formed on panel 30. Wall 52 and wall 54 are so proportioned that when lid 12 is brought into telescopic relation about base 14 they inter-engage to define a sealed, internally disposed tablet chamber 53. Preferably panel 30 includes a ledge portion 32 disposed outwardly of opposed sidewalls 24 and front wall 26 which is so proportioned that when lid 12 is telescopically positioned about bottom 14 no easily accessible liftable edges are provided; i.e., the extent by which ledge 32 extends outwardly of the respective walls will generally be equivalent to the thickness of the sidewalls 18 and front wall 20 of lid 12 as best seen in FIGS. 3 and 4. Container 10 is formed as a single piece by providing a generally U-shaped hinge 34 which connects rear wall 22 of lid 12 and rear wall 28 of base 14.

In order to provide for child-resistant opening features, interacting means, respectively on the rearward portion of lid 12 and base 14, are provided such that when container 10 is in a closed position compressive forces exerted between panel 16 and panel 10 will not effect an opening of container 10 unless exerted in a selective area which, in the preferred embodiment, will be the rearward corners of container 10. Generally these features are provided by having displaced surfaces on lid 12 and base 14 adapted and constructed so that as a compressive force is applied these surfaces are brought into closer proximity to each other and result in a lever-like lifting action of the lid relative to the base; additionally, cam means are provided on lid 12 and base 14 such that upon the exertion of such compressive force adjacently outwardly of the displaced surfaces, an outward movement of a portion of lid 12 relative to base 14 is effected which facilitates the lever-like pivotal opening.

In order to effect the foregoing rear wall 22 of lid 12 includes a lower central lateral surface 36 which merges at its extremities, through a generally upwardly and outwardly extending shoulder portions 37, with lateral side surfaces 38 which are disposed upwardly of central lateral surface 36. That is lateral side surfaces 38 are in closer proximity to panel 16 than is the lower central lateral surface 36. In a similar fashion rear wall 28 of base 14 is provided with an upper central lateral surface 40 which merges at its extremities, through generally outwardly and downwardly extending shoulder portions 41, with opposed downwardly disposed lateral side surfaces 42; i.e., opposed lower lateral side surfaces 42 are in closer proximity to panel 30 than is the upper central lateral surface 40. As will be apparent from the drawings the upper lateral side surfaces 38 of lid 12 are complementary to lower lateral side surfaces 42 of base 14 and are formed in adjacent corners of container 10 generally along the periphery container and intermediate fulcrum surfaces 46 and central lateral surfaces 36 and 40. Also generally disposed along the periphery of container 10 intermediate fulcrum surfaces 46 and the displaced surfaces, i.e., lateral side surfaces 38 and 42, container 10 is provided with camming means for effecting an outward movement of rearward portions of sidewall 18 relative to panel 30 upon selective application of compressive forces. In the preferred embodiment the camming means takes the form of providing base 14 with diametrically opposed downwardly and outwardly sloping surfaces 48 which are disposed adjacently beneath and rearwardly of fulcrum surfaces 46. Similarly the rearward portion of sidewalls 18 of lid 12 are provided with complementary downwardly and outwardly sloping, opposed cam surfaces 50 which, when the container is in a closed position, closely abut or even contact cam surfaces 48 in a generally flush-like manner.

Thus, in general, when lid 12 is telescopically positioned upon base 14 with the sidewalls 18 and front wall 20 being generally disposed outwardly of sidewall 24 and front wall 26 in a flush-like manner, wall 52 and wall 54 are brought into sealing inter-engagement to define the tablet chamber 53 and cam 50 is brought into close abutting relationship with cam 48. Central lateral surfaces 36 and 40 are likewise brought into close abutting relationship. Because of the ledge 32 it will be seen that there will be no significantly exposed edges which would allow for the convenient opening of the container anywhere along the sides or front thereof; i.e., if a compressive force is applied to lid 12 relative to base 14 tighter engagement results, not an opening engagement, and because of the lack of exposure of edges there is no convenient way of effecting an opening of the container. If outwardly directed forces are applied to complementary lateral side surfaces 38 and 42 opening of the container will not be effected. Furthermore, access to the displaced surface means, notably, side surfaces 38 and 42 can be substantially precluded by having hinge 34 substantially coextensive in length with the rear walls 22 and 28 respectively. When in a closed telescopic position, compressive forces applied to lid 12 and base 14, generally centrally between the rear walls 22 and 28, likewise will not effect a container opening because central surfaces 36 and 40 provide abutments which limit closer approaching motion to a point precluding opening of container 10. Thus an opening of the container is only conveniently effected by the selective application of a compressive force, generally represented by the arrow in FIG. 6, to lid 12 relative to base 14 at the corner of container 10. Thus upon application of such a compressive force the complementary displaced surfaces at the corner, i.e., upward side surface 38 and lower side surface 42 are brought into closer proximity to each other, notwithstanding contact of central surfaces 36 and 40, and the inner surface of panel 16 interacts with fulcrum surface 46 to effect a lever-like release, in a pivotal manner about hinge 34, of the telescopic engagement of lid 12 and base 14 and the concurrent release of the sealing inter-engagement of wall 54 and wall 52; this lever-like release is facilitated by contact of cam surface 50 with cam surface 48 to distort sidewall 18 adjacent cam 50 outwardly relative to panel 30. The lever-like action is exemplified in FIG. 6.

FIG. 7 represents an alternate embodiment for effecting the sealing engagement of wall 52 and wall 54. As seen therein wall 52 is provided with an annular recess 58 and wall 54 is provided with a bead-like portion 56, the recess and bead being so proportioned that they are brought into snug sealing engagement.

While the invention has been described with particularity above it will of course be apparent that modification is possible which pursuant to the patent laws and statutes do not depart from the spirit and scope of the present invention.

I claim:

1. A selectively openable, telescopically closeable tablet container molded as a single piece, said container comprising: a lid with a top panel having a peripheral skirt depending downwardly from said top panel; a base having a bottom panel and a skirt extending upwardly from said bottom panel, said base skirt having at least one downwardly extending surface which merges with an upper surface of said base skirt to define a fulcrum; hinge means joining said lid and base and allowing for said lid and base to be brought into telescopic relation; motion limiting means disposed inwardly of said hinge means for limiting relative closer approaching movement of said top panel and said bottom panel, when said lid and base are in closed telescopic relation, to a non-opening position; first wall means integral with top panel and second wall means integral with said bottom panel, said first and second wall means being inter-engageable to define a sealed, internally disposed tablet chamber upon relative telescopic positioning of said lid and base; displaced surface means generally disposed along the periphery of said container, at a location intermediate said motion limiting means and said fulcrum, so arranged and constructed that upon compression of adjacent portions of said top panel and bottom panel said surface means are brought into closer proximity to each so as to produce, along with contact of an internal surface portion of said top panel with said fulcrum, a lever-like action which disengages said first and second wall means to open said container and tablet chamber; and cam means, generally disposed along the periphery of said container intermediate said fulcrum and said displaces surface means, so arranged and constructed that upon said compression of said top and bottom panels a portion of said peripheral skirt of said lid is forced outwardly.

2. The container of claim 1 wherein said first and second wall means are generally cylindrical.

3. The container of claim 2 wherein one of said cylindrical wall means includes an annular recess and the other includes an annular bead which interlockingly engage upon telescopic relation of said lid and base.

4. The container of claim 1 wherein said cam means comprises a downwardly and outwardly sloping surface formed at the lower margin of a portion of said peripheral skirt of said lid.

5. The container of claim 4 wherein said cam means further includes a complementary cam surface integral with said base and disposed beneath said fulcrum surface.

6. The container of claim 1 wherein said hinge means is generally U-shaped.

7. The container of claim 1 wherein: said motion limiting means comprises a first end surface on a portion of said peripheral skirt of said lid and a second end surface on a portion of said skirt of said base, and said displaced surface means comprises a first lateral surface on said lid adjacent said motion limiting first end surface of said lid, said first lateral surface being in closer proximity to said top panel than said first end surface, and a second lateral surface on said base adjacent said second end surface, said second lateral surface being in closer proximity to said bottom panel than said second end surface.

8. The container of claim 2 wherein said container is generally quadrilateral and wherein two adjacent corners each include said displaced surface means and said cam means.

9. A one-piece, plastic tablet container comprising: a top having a panel and including downwardly depending opposed sidewalls and opposed front and rear walls;

a base having a panel and upwardly extending opposed sidewalls and opposed front and rear walls, said base and top being so arranged and constructed so as to allow them to be brought into telescopic relationship;

a hinge means joining said rear wall of said top to said rear wall of said bottom;

said rear wall of said top including a lower central surface which merges at its extremities with opposed upwardly disposed lateral surfaces, and said rear wall of said base including an upper central surface which merges at its extremities with opposed downwardly disposed lateral surfaces, said surfaces being so arranged that, when said top and base are in closed telescopic relation the distance between the central surfaces of said top and base is less than the distance between adjacently located lateral surfaces of said base and top; said opposed sidewalls of said base each including a fulcrum and said base further including opposed cam surfaces disposed rearwardly of and adjacently beneath the fulcrum surfaces; said sidewalls of said top including at their lower margins, adjacent the rear wall thereof, opposed cam surfaces, said latter cam surfaces being respectively disposed complementarily upwardly of said cam surfaces of said base portion when said top and base portions are in telescopic relation; and telescopically inter-engaging means respectively carried by said top and base for defining a sealed tabletstorage chamber when said top and base are in telescopic relation, said container being so arranged that when central compressive forces are applied said lower central surface and said upper central surface of said rear walls preclude disengagement of said inter-engaging means, but when compressive forces are applied at the rearward corners of said container, adjacent the respective lateral surfaces, said camming surfaces of said base and top slippingly inter-engage to cause an outward movement of said top sidewalls and said inter-engaging means are disengaged in a lever-like manner during contacting engagement of the internal surface of said panel of said top with a fulcrum surface of said base.

* * * * *